United States Patent [19]

Brandin

[11] 4,229,949

[45] Oct. 28, 1980

[54] REFRIGERATION SYSTEM

[75] Inventor: Tore Brandin, Norrkoping, Sweden

[73] Assignee: Stal Refrigeration AB, Norrkoping, Sweden

[21] Appl. No.: 8,174

[22] Filed: Jan. 31, 1979

[30] Foreign Application Priority Data

Feb. 7, 1978 [SE] Sweden ..... 7801379

[51] Int. Cl.[3] ..... F25B 43/00

[52] U.S. Cl. ..... 62/503; 62/511; 62/527

[58] Field of Search ..... 62/83, 174, 503, 511, 62/527; 138/48

[56] References Cited

U.S. PATENT DOCUMENTS

| | | | |
|---|---|---|---|
| 1,406,398 | 2/1922 | Livingston | 138/40 |
| 1,484,235 | 2/1924 | Raba | 138/40 |
| 1,505,961 | 8/1924 | Joubert | 138/40 |
| 2,120,764 | 6/1938 | Newton | 62/83 |

*Primary Examiner*—Ronald C. Capossela
*Attorney, Agent, or Firm*—Cyrus S. Hapgood

[57] ABSTRACT

A compressor, a condenser, an expansion valve and an evaporator are interconnected in a refrigeration circuit, the evaporator discharging the refrigerant toward the compressor as a two-phase flow which is a mixture of liquid particles and superheated vapor. A flow disturbing element is located in the circuit downstream from the evaporator and operates to give the two flowing phases an increased mutual relative speed.

1 Claim, 3 Drawing Figures

REFRIGERATION SYSTEM

Figure 1:
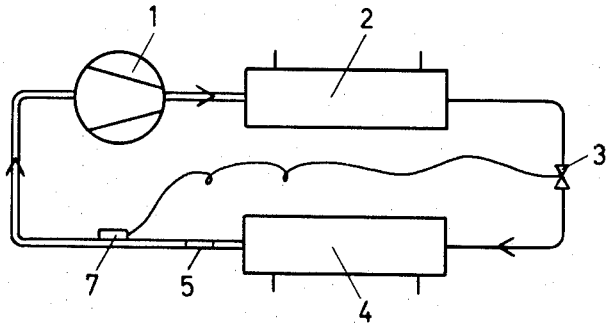

This invention relates to a refrigeration system of the type comprising a compressor, a condenser, an expansion valve and an evaporator connected in a circuit enclosing a refrigerant flowing in it, the evaporator being arranged so that the refrigerant leaves it as a two-phase flow, i.e., a mixture of flowing liquid particles and flowing superheated vapor, in the direction of the compressor.

In refrigeration systems of this type, it is extremely important that the refrigerant in particle form does not reach the compressor, which could be damaged in such a case. Even in view of a stable control, it is necessary that the feed of refrigerant to the evaporator be such that the extent of superheating is greater than would be desirable from a heat transfer point of view. To obtain this extent of superheating, a considerable share of the heat transfer surface of the evaporator must be used for superheating vapor instead of transferring liquid into vapor. The heat transfer number for superheating of vapor is much lower than that for transferring liquid into vapor, which means that the surface will be inefficiently utilized.

To eliminate this drawback, a heat exchanger may be included in the circuit between the evaporator and the compressor. In this heat exchanger, heat from the relatively hot refrigerant in liquid form, flowing from the condenser to the expansion valve, is transferred to the mixture of vapor and liquid particles flowing from the evaporator. In order that the liquid particles are completely transferred into vapor, a relatively large heat transfer surface is needed, which means a considerable cost. The pressure drop in the circuit is also reduced, which means decreased cooling efficiency. It has also been attempted to utilize the evaporator better by providing beyond it a liquid separator from which refrigerant in liquid form is recirculated and is conveyed through the evaporator. Such a design is relatively complicated and does not afford any efficient solution of the problem.

The present invention aims at providing a refrigeration system of the above-mentioned type where the heat transfer surface of the evaporator is well utilized and where the refrigerant, when entering the compressor, does not contain any liquid particles.

A refrigeration system made according to the invention is characterized in that at least one flow disturbing element is provided in the circuit after the evaporator, in the flow direction of the refrigerant, which element is designed to give the flowing phases an increased mutual relative speed. In this way, the heat transfer rate from the superheated vapor to the liquid particles is improved, in order that the refrigerant will quickly exist exclusively as vapor phase. In this connection, the expansion valve is controlled in order that the phase state of the refrigerant, after a contemplated temperature equalization, corresponds to vapor superheated to some extent.

In one preferred embodiment, the flowing disturbing element is formed as a disc provided with openings arranged perpendicularly to the flow direction of the refrigerant. When the mixture of liquid particles and superheated vapor flows through the openings, turbulence is created, which increases the mutual relative speed between said two refrigerant phases, so that the temperature equalization is accelerated.

In an especially suitable embodiment of the invention, said disc is provided with cuts extending from the edge, the resulting flaps being twisted in order to form baffles guiding the flow. Said flaps may be twisted about 45°. When the flow of liquid particles hits these baffles, the particles will be retarded, and the liquid particles leave the baffles substantially in the direction of same, whereas the flow of vapor is given a screw-formed path. The mutual relative speed between the liquid particles and the vapor will thus increase considerably. Even in the case where the element is formed with twisted flaps in such a way that the minimal flow area is only 30 to 40% of the area in the flow direction, where the element is provided, the total pressure drop will be small, as static pressure is regained after the flow disturbing or guide element.

Two or more flow disturbing elements can, of course, be arranged in the circuit of a refrigeration system. In practice, the actual number is determined by the operational conditions and the design of the element. If a heat exchanger is provided after the evaporator, one element can be utilized especially efficiently if it is arranged after said heat exchanger. The temperature difference between the liquid particles and the superheated vapor in this case has increased still more, which will facilitate the heat transfer from vapor to liquid particles.

Figure 2:
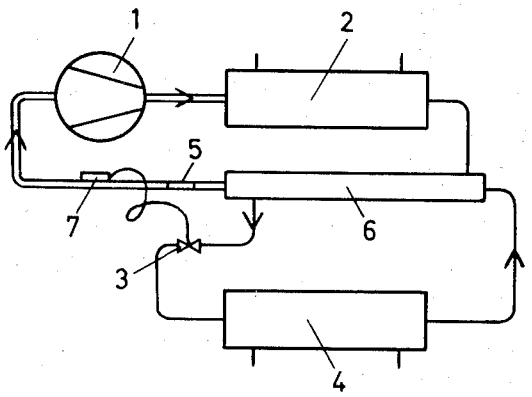
Figure 3:
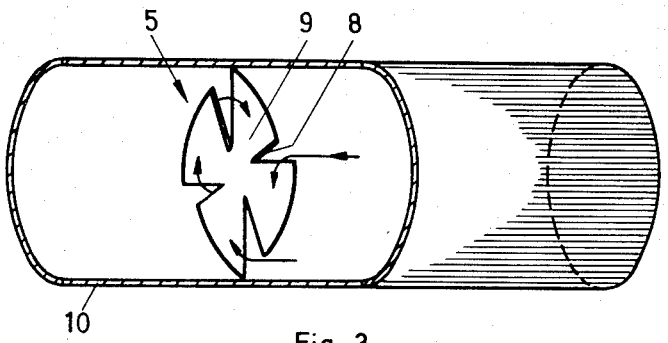

The invention will now be described more in detail with reference to the accompanying drawing, in which FIG. 1 is a schematic view of a refrigeration system according to the invention;

FIG. 2 is a similar view of a refrigeration system according to the invention, provided with a heat exchanger; and FIG. 3 is a perspective view of one embodiment of a flow disturbing element according to the invention.

In FIGS. 1 and 2, a circuit is formed by a compressor 1, a condenser 2, an expansion valve 3 and an evaporator 4. In FIG. 2 there is also a heat exchanger 6 in which heat is transferred from the relatively hot flow of refrigerant between condenser 2 and expansion valve 3 to the mixture of liquid particles and vapor, coming from evaporator 4. A sensing means is provided for sensing the superheating state of the refrigerant after the evaporator. Sensing means 7 is connected to and controls expansion valve 3. A flow disturbing element 5 is located downstream from evaporator 4 and upstream from compressor 1.

As shown in FIG. 3, the flow disturbing element 5 consists of a round disc provided with cuts 8 to form flaps 9, which are twisted to form baffles. Disc 5 fits closely in pipe 10 connecting evaporator 4 to compressor 1.

In the operation of the system, expansion valve 3 is controlled so that the refrigerant immediately after evaporator 4 (or after heat exchanger 6) consists of such a mixture of liquid particles and superheated vapor that the phase state of the refrigerant at a contemplated temperature equalization corresponds to vapor, superheated to some extent. When the two-phase flow of refrigerant passes the flow disturbing guide element 5, the mutual relative speed between the two phase flows is increased, so that the temperature is quickly equalized. This insures that the refrigerant will enter compressor 1 exclusively in the form of somewhat superheated vapor.

It should be noted that heat exchanger 6 in FIG. 2 is considerably smaller than the heat exchangers commonly used heretofore in this context. Thus, it will not genreate any disadvantageous, large pressure drop in the circuit.

I claim:

1. In a refrigeration system, the combination of a series of elements interconnected in a circuit, said elements comprising a compressor, a condenser, an expansion valve and an evaporator, a refrigerant enclosed in said circuit and adapted to flow through the circuit, said evaporator being operable to discharge the refrigerant toward the compressor as a two-phase flow which is a mixture of flowing liquid particles and flowing superheated vapor, and a flowing disturbing disc located in said circuit downstream from the evaporator and operable to give said flowing phases an increased mutual relative speed, said disc being arranged perpendicularly to the flow direction of the refrigerant and provided with openings formed by cuts extending from the periphery of the disc and dividing the disc into flaps, said flaps being twisted about 45° to form baffles for guiding the flow.

* * * * *